US010125416B2

(12) United States Patent
Omori et al.

(10) Patent No.: US 10,125,416 B2
(45) Date of Patent: Nov. 13, 2018

(54) STEEL FOR NITROCARBURIZING AND NITROCARBURIZED COMPONENT, AND METHODS FOR PRODUCING SAID STEEL FOR NITROCARBURIZING AND SAID NITROCARBURIZED COMPONENT

(71) Applicants: JFE STEEL CORPORATION, Tokyo (JP); JFE Bars & Shapes Corporation, Tokyo (JP)

(72) Inventors: Yasuhiro Omori, Kurashiki (JP); Kiyoshi Uwai, Kurashiki (JP); Shinji Mitao, Nagoya (JP); Takashi Iwamoto, Kurashiki (JP); Keisuke Ando, Sendai (JP); Kunikazu Tomita, Tagajo (JP)

(73) Assignees: JFE STEEL CORPORATION, Tokyo (JP); JFE BARS AND SHAPES, Tokyo (JP)

( * ) Notice: Subject to any disclaimer, the term of this patent is extended or adjusted under 35 U.S.C. 154(b) by 331 days.

(21) Appl. No.: 14/413,549

(22) PCT Filed: Jul. 22, 2013

(86) PCT No.: PCT/JP2013/004459
§ 371 (c)(1),
(2) Date: Jan. 8, 2015

(87) PCT Pub. No.: WO2014/017074
PCT Pub. Date: Jan. 30, 2014

(65) Prior Publication Data

US 2015/0159261 A1 Jun. 11, 2015

(30) Foreign Application Priority Data

Jul. 26, 2012 (JP) ..... 2012-166302

(51) Int. Cl.
*C23C 8/32* (2006.01)
*C21D 8/06* (2006.01)
(Continued)

(52) U.S. Cl.
CPC ..... *C23C 8/32* (2013.01); *C21D 1/06* (2013.01); *C21D 6/002* (2013.01); *C21D 6/005* (2013.01);
(Continued)

(58) Field of Classification Search
CPC .... C23C 8/32; C23C 8/04; C21D 8/06; C21D 9/32; C21D 1/06; C21D 8/065;
(Continued)

(56) References Cited

U.S. PATENT DOCUMENTS 4,421,574 A * 12/1983 Lyudkovsky ..... C21D 8/12 148/111
2007/0029015 A1* 2/2007 Yoshinaga ..... C21D 6/005 148/533
(Continued)

FOREIGN PATENT DOCUMENTS

CN 101128611 A 2/2008
CN 102089452 A 6/2011
(Continued)

OTHER PUBLICATIONS

ASM International, Materials Park, Ohio, Handbook of Residual Stress and Deformation of Steel, "Effect of Residual Stress of Hydrogen Embrittlement and Stress Corrosion Cracking", pp. 70-85, Mar. 2002.*
(Continued)

*Primary Examiner* — Jessee R Roe
(74) *Attorney, Agent, or Firm* — Oliff PLC

(57) ABSTRACT

The present invention provides a steel for nitrocarburizing having excellent mechanical workability before nitrocarbur-
(Continued)

izing, and showing excellent fatigue properties after nitrocarburizing, which is suitable for applying in mechanical structural components for automobiles etc. prepared by adjusting the composition so that it contains in mass %, C: 0.01% or more and less than 0.10%, Si: 1.0% or less, Mn: 0.5% to 3.0%, P: 0.02% or less, S: 0.06% or less, Cr: 0.3% to 3.0%, Mo: 0.005% to 0.4%, V: 0.02% to 0.5%, Nb: 0.003% to 0.15%, Al: 0.005% to 0.2%, and Sb: 0.0005% to 0.02%, and the balance including Fe and incidental impurities, and setting the area ratio of bainite phase to the whole microstructure to more than 50%.

7 Claims, 1 Drawing Sheet

(51) Int. Cl.

| | |
|---|---|
| ***C21D 9/32*** | (2006.01) |
| ***C21D 1/06*** | (2006.01) |
| ***C22C 38/00*** | (2006.01) |
| ***C22C 38/60*** | (2006.01) |
| ***C22C 38/02*** | (2006.01) |
| ***C22C 38/04*** | (2006.01) |
| ***C22C 38/06*** | (2006.01) |
| ***C22C 38/22*** | (2006.01) |
| ***C22C 38/24*** | (2006.01) |
| ***C22C 38/26*** | (2006.01) |
| ***C22C 38/28*** | (2006.01) |
| ***C22C 38/38*** | (2006.01) |
| ***C21D 6/00*** | (2006.01) |
| ***C21D 8/00*** | (2006.01) |
| ***C23C 8/04*** | (2006.01) |

(52) U.S. Cl.
CPC ..... *C21D 6/008* (2013.01); *C21D 8/005* (2013.01); *C21D 8/06* (2013.01); *C21D 8/065* (2013.01); *C21D 9/32* (2013.01); *C22C 38/00* (2013.01); *C22C 38/001* (2013.01); *C22C 38/02* (2013.01); *C22C 38/04* (2013.01); *C22C 38/06* (2013.01); *C22C 38/22* (2013.01); *C22C 38/24* (2013.01); *C22C 38/26* (2013.01); *C22C 38/28* (2013.01); *C22C 38/38* (2013.01); *C22C 38/60* (2013.01); *C23C 8/04* (2013.01); *C21D 2211/002* (2013.01); *C21D 2211/004* (2013.01)

(58) Field of Classification Search
CPC ..... C21D 6/002; C21D 6/005; C21D 6/008; C21D 2211/002; C21D 2211/004; C22C 38/00; C22C 38/60; C22C 38/001; C22C 38/02; C22C 38/04; C22C 38/06; C22C 38/22; C22C 38/24; C22C 38/26; C22C 38/28; C22C 38/38
See application file for complete search history.

(56) References Cited

U.S. PATENT DOCUMENTS

| | | | |
|---|---|---|---|
| 2008/0000553 | A1 | 1/2008 | Sano et al. |
| 2011/0017363 | A1 | 1/2011 | Kang et al. |
| 2011/0186182 | A1* | 8/2011 | Chida ..... B32B 15/04 148/318 |
| 2013/0061989 | A1 | 3/2013 | Nakamura et al. |
| 2013/0087250 | A1 | 4/2013 | Chida et al. |

FOREIGN PATENT DOCUMENTS

| | | | |
|---|---|---|---|
| EP | 2357262 | A1 | 8/2011 |
| JP | H05-59488 | A | 3/1993 |
| JP | H08-81734 | A | 3/1996 |
| JP | 2002-069572 | A | 3/2002 |
| JP | 2004-332100 | A | 11/2004 |
| JP | 2010-163671 | A | 7/2010 |
| JP | 2011-122208 | A | 6/2011 |
| JP | 2012-012701 | A | 1/2012 |
| JP | 2012-087361 | A | 5/2012 |
| WO | 2009/084795 | A1 | 7/2009 |
| WO | 2011/099408 | A1 | 8/2011 |
| WO | 2011/152541 | A1 | 12/2011 |
| WO | 2012/067181 | A1 | 5/2012 |

OTHER PUBLICATIONS

Mar. 29, 2016 Office Action Issued in Korean Patent Application No. 10-2015-7003310.
Dec. 2, 2016 Office Action issued in Chinese Patent Application No. 201380039030.7.
Nov. 30, 2015 Extended Search Report issued in European Patent Application No. 13823507.2.
Sep. 17, 2013 International Search Report issued in International Patent Application No. PCT/JP2013/004459.
Jan. 29, 2016 Office Action issued in Chinese Patent Application No. 201380039030.7.

* cited by examiner

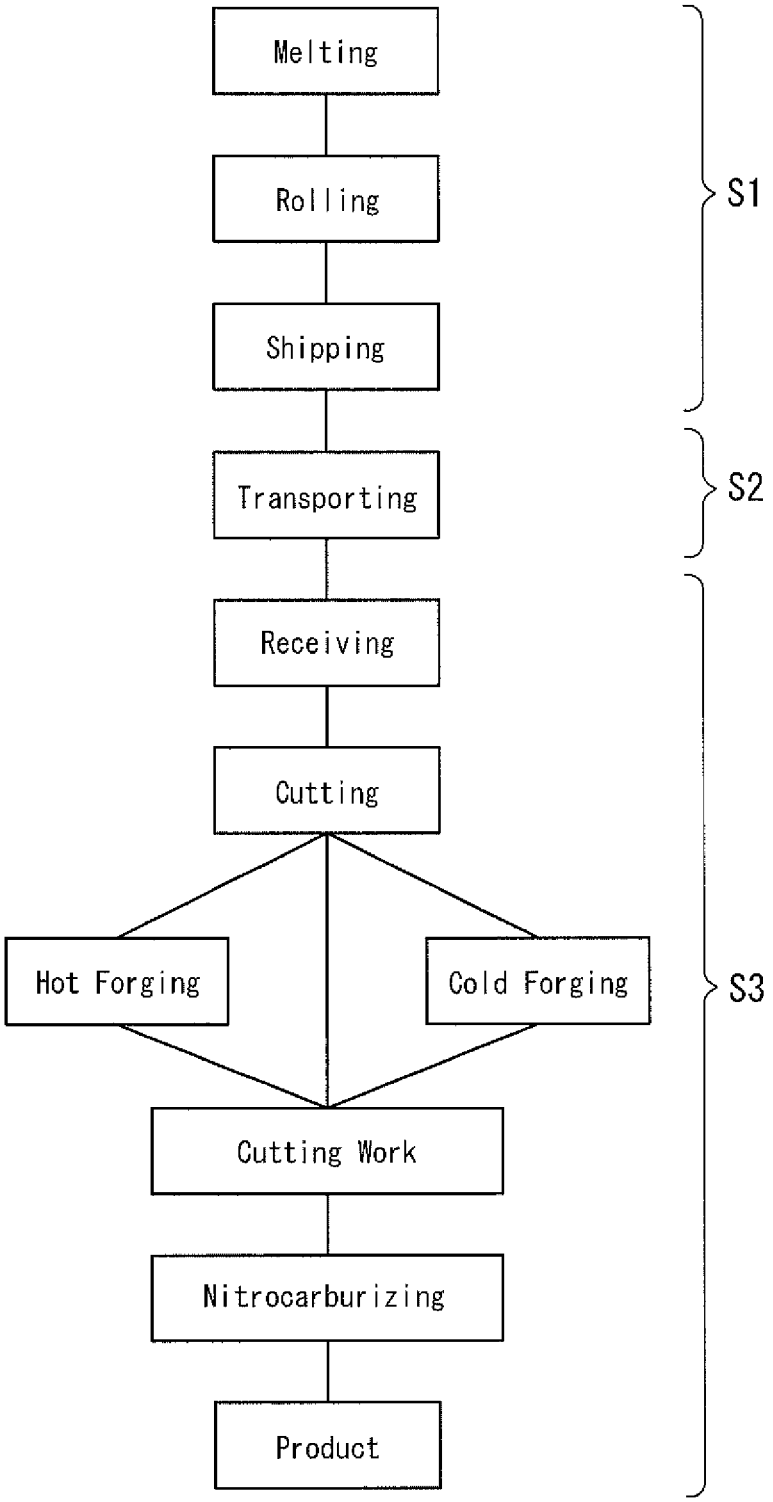
Melting
Rolling
Shipping
S1
Transporting
S2
Receiving
Cutting
Hot Forging
Cold Forging
S3
Cutting Work
Nitrocarburizing
Product

STEEL FOR NITROCARBURIZING AND NITROCARBURIZED COMPONENT, AND METHODS FOR PRODUCING SAID STEEL FOR NITROCARBURIZING AND SAID NITROCARBURIZED COMPONENT

TECHNICAL FIELD

The present invention relates to steel for nitrocarburizing, a nitrocarburized component obtained from the steel for nitrocarburizing, and methods for producing said steel for nitrocarburizing and said nitrocarburized component, and in particular, to those having excellent fatigue properties after nitrocarburizing treatment which are suitable for use as components for automobiles and construction machinery.

BACKGROUND ART

Since excellent fatigue properties are desired for machine structural components such as automobile gears, surface hardening treatment is usually performed when manufacturing such components. Examples of well-known surface hardening treatment include carburizing treatment, induction quench hardening, and nitriding treatment.

Among these, in carburizing treatment, C is immersed and diffused in high-temperature austenite region and a deep hardening depth is obtained. Therefore, carburizing treatment is effective in improving fatigue strength. However, since heat treatment distortion occurs by carburizing treatment, it was difficult to apply such treatment to components which require severe dimensional accuracy from the perspective of noise or the like.

Further, in induction quench hardening, since quenching is performed on the surface layer part by high frequency induction heating, heat treatment distortion is generated, and therefore results in poor dimensional accuracy as in the case with carburizing treatment.

On the other hand, in nitriding treatment, surface hardness is increased by immersing and diffusing nitrogen in a relatively low temperature range at or below the $Ac_1$ transformation point, and therefore there is no possibility of heat treatment distortion such as mentioned above. However, there were problems that the treatment requires a long time of 50 hours to 100 hours, and then it is necessary to remove brittle compound layers on the surface layer after performing the treatment.

Therefore, nitrocarburizing treatment in which treatment is performed at a treatment temperature almost equal to nitriding treatment temperature and in a shorter treatment time was developed, and in recent years, such treatment has been widely used for machine structural components and the like. During this nitrocarburizing treatment, N and C are simultaneously infiltrate and diffused in a temperature range of 500° C. to 600° C. to harden the surface, and the treatment time can be made half of what is required for conventional nitriding treatment.

However, whereas the above mentioned carburizing treatment enables to increase the core hardness by quench hardening, nitrocarburizing treatment does not increase core hardness since the treatment is performed at a temperature at or below the transformation point of steel. Therefore, fatigue strength of the nitrocarburized material is inferior compared to the carburized material.

In order to improve the fatigue strength of the nitrocarburized material, quenching and tempering are usually performed before nitrocarburizing to increase the core hardness. However, the resulting fatigue properties cannot be considered sufficient. Furthermore, this approach increases manufacturing costs and reduces mechanical workability.

In order to solve such problem, JPH0559488A (PTL 1) proposes a steel for nitrocarburizing which enables to obtain high bending fatigue strength after nitrocarburizing treatment by containing Ni, Al, Cr, Ti, etc. in steel.

Regarding this steel, by performing nitrocarburizing treatment, the core part is age hardened by Ni—Al based or Ni—Ti based intermetallic compounds or Cu compounds, while in the surface layer part, for example, Cr, Al, Ti nitrides or carbides are precipitated and hardened in the nitride layer, to improve bending fatigue strength.

JP200269572A (PTL 2) proposes a steel for nitrocarburizing which provides excellent bending fatigue properties after nitrocarburizing treatment by subjecting a steel containing 0.5% to 2% of Cu to extend forging by hot forging, and then air cooling to obtain a microstructure mainly composed of ferrite with solute Cu, and then precipitating the Cu to contribute to precipitation hardening during nitrocarburizing treatment at 580° C. for 120 minutes, and further use precipitation hardening by carbonitrides of Ti, V and Nb with precipitation hardening by Cu.

JP2010163671A (PTL 3) proposes a steel for nitrocarburizing obtained by dispersing Ti—Mo carbides, and further dispersing carbides containing at least one of Nb, V, and W.

CITATION LIST

Patent Literature

PTL 1: JPH0559488A
PTL 2: JP200269572A
PTL 3: JP2010163671A

SUMMARY OF INVENTION

Technical Problem

However, regarding the steel for nitrocarburizing disclosed in PTL 1, although bending fatigue strength is improved by precipitation hardening of Ni—Al based or Ni—Ti based intermetallic compounds or Cu compounds, the resulting workability cannot be considered sufficient. Furthermore, regarding the steel for nitrocarburizing disclosed in PTL 2, it is necessary to add a relatively large amount of Cu, Ti, V, Nb, and therefore it has a problem that manufacturing costs are high. Further, the steel for nitrocarburizing disclosed in PTL 3 contains a relatively large amount of Ti and Mo, and therefore this also has a problem that it is high in cost.

The present invention advantageously solves the above problem, and an object thereof is to provide a steel for nitrocarburizing which ensures mechanical workability by suppressing hardening before nitrocarburizing treatment and a method for manufacturing the same.

Further, another object of the present invention is to provide a nitrocarburized component which enables improving fatigue properties by increasing core hardness by nitrocarburizing treatment after machining and a method for manufacturing the same.

Solution to Problem

In order to solve the above problems, the inventors of the present invention intensely investigated the influence of chemical composition and microstructure of steel.

As a result, the inventors discovered that by arranging a steel to have a chemical composition containing an appropriate amount of V and Nb, and to have a microstructure such that the area ratio of bainite phase is more than 50%, the resulting steel may have excellent mechanical workability without containing relatively expensive elements such as Ti and Cu, and that after nitrocarburizing treatment, by dispersedly forming fine precipitates containing V and Nb in the core part and increasing core hardness, excellent fatigue properties can be obtained.

The present invention has been completed based on the above findings and further considerations.

Specifically, the primary features of the present invention are as follows.

1. A steel for nitrocarburizing comprising, in mass %

C: 0.01% or more and less than 0.10%,

Si: 1.0% or less,

Mn: 0.5% to 3.0%,

P: 0.02% or less,

S: 0.06% or less,

Cr: 0.3% to 3.0%,

Mo: 0.005% to 0.4%,

V: 0.02% to 0.5%,

Nb: 0.003% to 0.15%,

Al: 0.005% to 0.2%,

Sb: 0.0005% to 0.02%, and the balance including Fe and incidental impurities, wherein the area ratio of bainite phase to the whole microstructure is more than 50%.

2. A nitrocarburized component obtained by forming the steel for nitrocarburizing according to aspect 1 into a desired shape, and then subjecting it to nitrocarburizing.

3. The nitrocarburized component according to aspect 2, wherein after the nitrocarburizing, precipitates including V and Nb are dispersedly formed in a bainite phase.

4. A method for manufacturing a steel for nitrocarburizing, the method comprising:

hot working a steel at a heating temperature of 950° C. to 1250° C. and finishing temperature of 800° C. or higher, the steel having a chemical composition comprising, in mass %

C: 0.01% or more and less than 0.10%,

Si: 1.0% or less,

Mn: 0.5% to 3.0%,

P: 0.02% or less,

S: 0.06% or less,

Cr: 0.3% to 3.0%,

Mo: 0.005% to 0.4%,

V: 0.02% to 0.5%,

Nb: 0.003% to 0.15%,

Al: 0.005% to 0.2%,

Sb: 0.0005% to 0.02%, and the balance including Fe and incidental impurities; and then cooling the worked steel at a cooling rate of more than 0.5° C./s at least in a temperature range of 700° C. to 550° C.

5. A method for manufacturing a nitrocarburized component, wherein the steel for nitrocarburizing obtained by the manufacturing method according to aspect 4 is formed into a desired shape and then subjected to nitrocarburizing at a nitrocarburizing temperature of 550° C. to 700° C. for a nitrocarburizing time of 10 minutes or longer.

Advantageous Effect of Invention

According to the present invention, it is possible to obtain a steel for nitrocarburizing excellent in mechanical workability using inexpensive chemical systems, and after performing nitrocarburizing treatment, it is possible to obtain a nitrocarburized component with having fatigue properties comparable to or better than the material of JIS SCr420 which has been subjected to carburizing treatment.

Further, the nitrocarburized component of the present invention is very useful for applying in mechanical structural components for automobiles etc.

BRIEF DESCRIPTION OF DRAWINGS

The present invention will be further described below with reference to the accompanying drawings, wherein:

FIG. 1 shows a typical manufacturing process of a nitrocarburized component.

DESCRIPTION OF EMBODIMENTS

The present invention will be specifically described below.

First, reasons for limiting the chemical composition to the aforementioned ranges in the present invention will be described. Unless otherwise specified, the indication of "%" regarding the chemical composition below shall stand for "mass %".

C: 0.01% or More and Less than 0.10%

C is added for bainite phase formation and securing strength. However, when an amount of C is less than 0.01%, a sufficient amount of bainite phase cannot be obtained, and further the amount of V and Nb precipitates after nitrocarburizing treatment becomes insufficient, making it difficult to guarantee sufficient strength properties. Therefore, the amount of C is set to be 0.01% or more. On the other hand, when C is added in an amount of 0.10% or more, hardness of the formed bainite phase increases, thereby reducing the mechanical workability. Therefore, the amount of C added is set to be less than 0.10%, preferably, 0.03% or more and less than 0.10%.

Si: 1.0% or Less

Si is added for its usefulness in deoxidation and bainite phase formation. However, an amount of Si exceeding 1.0% causes solid solution hardening of ferrite phase and bainite phase, and deteriorates mechanical workability and cold workability. Therefore, the amount of Si is set to be 1.0% or less, preferably 0.5% or less, and more preferably 0.3% or less.

Note that for Si to contribute effectively to deoxidation, the amount of Si added is preferably set to be 0.01% or more.

Mn: 0.5% to 3.0%

Mn is added for its usefulness in bainite phase formation and in increasing strength. However, when an amount of Mn is less than 0.5%, the amount of bainite phase formed decreases, and V and Nb precipitates are formed in the bainite phase before nitrocarburizing and thereby causes an increase of hardness before nitrocarburizing. In addition, since the absolute amount of V and Nb precipitates after nitrocarburizing decreases, hardness after nitrocarburizing decreases, making it difficult to guarantee sufficient strength properties. Therefore, the amount of Mn is set to be 0.5% or more. On the other hand, since the amount of Mn exceeding 3.0% deteriorates mechanical workability and cold workability, the amount of Mn is set to be 3.0% or less, preferably in the range of 0.5% to 2.5%, and more preferably in the range of 0.6% to 2.0%.

P: 0.02% or Less

P segregates in austenite grain boundaries, and lowers grain boundary strength, thereby lowering strength and toughness. Accordingly, P content is preferably kept as small as possible, but a content of up to 0.02% is tolerable.

Note that setting the content of P to be less than 0.001% requires a high cost. Therefore, it suffices in industrial terms to reduce the content of P to 0.001%.

S: 0.06% or Less

S is a useful element that forms MnS in the steel to improve machinability by cutting, S content exceeding 0.06% causes deterioration of toughness. Accordingly, the amount of S is limited to 0.06% or less, preferably 0.04% or less.

Note that for S to achieve the effect of improving machinability by cutting, the amount of S is preferably set to be 0.002% or more.

Cr: 0.3% to 3.0%

Cr is added for its usefulness in bainite phase formation. However, when an amount of Cr is less than 0.3%, the amount of bainite phase formed decreases, and V and Nb precipitates are formed in the bainite phase before nitrocarburizing, causing an increase of hardness. In addition, since the absolute amount of V and Nb precipitates after nitrocarburizing decreases, hardness after nitrocarburizing decreases, making it difficult to guarantee sufficient strength properties. Therefore, the amount of Cr is set to be 0.3% or more. On the other hand, since Cr content exceeding 3.0% deteriorates mechanical workability and cold workability, the amount of Cr added is set to be 3.0% or less, preferably in the range of 0.5% to 2.0%, and more preferably in the range of 0.5% to 1.5%.

Mo: 0.005% to 0.4%

Mo causes fine V and Nb precipitates and is effective in improving the strength of the nitrocarburized material. Therefore Mo is an important element for the present invention. It is also effective in bainite phase formation. In order to improve strength, Mo is added in an amount of 0.005% or more. However, since Mo is an expensive element, adding Mo more than 0.4% leads to an increase in component costs. Accordingly, the amount of Mo is set to be in the range of 0.005% to 0.4%, preferably in the range of 0.01% to 0.3%, and more preferably in the range of 0.04% to 0.2%.

V: 0.02% to 0.5%

V is an important element which forms fine precipitates with Nb due to the temperature rise during nitrocarburizing to thereby increase core hardness and improve strength. Since an added amount of V less than 0.02% does not satisfactorily achieve these effects, V is set to be 0.02% or more. On the other hand, adding an amount of V exceeding 0.5% causes the precipitates to coarsen and sufficient improvement in strength cannot be obtained. Therefore, the amount of V is set to be 0.5% or less, preferably in the range of 0.03% to 0.3%, and more preferably in the range of 0.03% to 0.25%.

Nb: 0.003% to 0.15%

Nb forms fine precipitates with V due to temperature rise during nitrocarburizing and increases core hardness, and is therefore extremely effective for improvement in fatigue strength. Since an added amount of Nb less than 0.003% does not satisfactorily achieve these effects, Nb is set to be 0.003% or more. On the other hand, adding an amount of Nb exceeding 0.15% causes the precipitates to coarsen and a sufficient improvement in strength cannot be obtained. Therefore, the amount of Nb added is set to be 0.15% or less, preferably in the range of 0.02% to 0.12%.

Al: 0.005% to 0.2%

Al is a useful element to improve surface hardness and effective hardened case depth after nitrocarburizing, and therefore it is intentionally added. Al also yields a finer microstructure by inhibiting the growth of austenite grains during hot forging and is thus a useful element to improve toughness. Therefore, an amount of Al added is 0.005% or more. On the other hand, including over 0.2% does not increase this effect, but rather causes the disadvantage of higher component cost. Accordingly, the amount of Al added is 0.2% or less. The amount is preferably in the range of 0.020% to 0.1%, more preferably in the range of 0.020% to 0.040%.

Sb: 0.0005% to 0.02%

Sb provides an effect of promoting bainite phase formation. When the amount of Sb added is less than 0.0005%, the additive effect is poor. On the other hand, including over 0.02% does not increase this effect, and causes not only an increase in component costs but also a degradation of toughness due to segregation. Therefore, the amount of Sb added is 0.0005% to 0.02%, preferably in the range of 0.0010% to 0.01%.

In the steel material of the present invention, components other than described above are Fe and incidental impurities.

Ti in particular has a harmful effect on the strengthening by precipitation of V and Nb and reduces core hardness. Therefore, Ti content should be minimized, preferably to less than 0.010%, and more preferably to less than 0.005%.

Further, although N is contained as an incidental impurity, if N content increases, coarse VN precipitates are formed to cause the degradation of toughness. Therefore, the upper limit of N content is preferably set to 0.02%.

Next, reasons for limiting the microstructure of the steel for nitrocarburizing in the present invention to the aforementioned ranges will be described.

Area Ratio of Bainite Phase to the Whole Microstructure: More than 50%

In the present invention, it is very important that the area ratio of bainite phase to the whole microstructure is more than 50%.

The present invention intends to improve fatigue strength after nitrocarburizing by V and Nb precipitates dispersed in the core part other than the nitrided surface layer part after nitrocarburizing to increase core hardness.

Here, if V and Nb precipitates exist before nitrocarburizing, it is disadvantageous from the viewpoint of machinability by cutting at the time of cutting work which is normally performed before nitrocarburizing. Further, in the bainite transformation process, V and Nb precipitates are less easily formed in the matrix phase as compared to the ferrite-pearlite transformation process.

Therefore, the microstructure of the steel for nitrocarburizing in the present invention i.e. the steel microstructure before nitrocarburizing is mainly composed of bainite phase. Specifically, the area ratio of bainite phase to the whole microstructure is set to be more than 50%, preferably more than 60%, and more preferably more than 80%. The area ratio may also be 100%.

Although possible microstructures other than the bainite phase include the ferrite phase or the pearlite phase, it goes without saying that the less of these microstructures, the more preferred.

The area ratio of each phase is observed by collecting test specimens from the obtained steel for nitrocarburizing, polishing and then etching by nital the specimens at their cross section parallel to the rolling direction (L-section), and identifying the phase type by observing the cross sectional microstructure (microstructure observation using an optical microscope of 200 magnifications) using an optical microscope or a scanning electron microscope (SEM).

In the nitrocarburized component of the present invention, nitrocarburizing is performed on the steel for nitrocarburizing of the present invention, and precipitates including V and Nb are dispersed in the bainite phase.

The reason for this is that by V and Nb precipitates dispersed in the core microstructure other than the nitrocarburized surface layer part, core hardness increases and fatigue strength after nitrocarburizing is significantly improved.

The diameter of precipitates including V and Nb in bainite phase is preferable set to less than 10 nm in order for them to contribute to precipitation strengthening after nitrocarburizing. The measuring limit of the diameter of the precipitate is around 1 nm.

Further, regarding the number of precipitates, it is preferable that 500 precipitates or more exist per 1 $\mu m^2$ in order to sufficiently strengthen precipitation. On the other hand, the upper limit is preferably set to 10000 precipitates per 1 $\mu m^2$.

Next, methods for manufacturing a steel for nitrocarburizing and a nitrocarburized component according to the present invention will be described.

FIG. 1 shows the typical manufacturing process for manufacturing nitrocarburized components using steels for nitrocarburizing (steel bars) according to the present invention. Here, S1 is the step of manufacturing a steel bar which is a blank material, S2 is the step of transporting the steel bar, and S3 is the step of finishing the steel bar into a product (a nitrocarburized component).

First, in the steel bar manufacturing step (S1), a steel ingot is subjected to hot rolling to obtain a steel bar, and after being subjected to quality inspection, the steel bar is shipped.

Then, after being transported (S2), in the step of finishing the steel bar into a product (a nitrocarburized component) (S3), the steel bar is cut into a predetermined size, subjected to hot forging or cold forging, formed into a desired shape (e.g. gear or shaft components) by cutting work such as drill boring or lathe turning as necessary, then subjected to nitrocarburizing and made into a product.

Further, in some cases, the hot rolled material is directly subjected to cutting work such as lathe turning or drill boring to form a desired shape, and then subjected to nitrocarburizing and made into a product. In the case of hot forging, there are cases where cold straightening is performed after hot forging. There are also cases where the final product is subjected to coating treatment such as painting or plating.

In the method for manufacturing the steel for nitrocarburizing of the present invention, by setting the heating temperature and the working temperature at the time of hot working to a certain condition in the hot working process right before nitrocarburizing, a microstructure composed mainly of bainite phase is obtained as mentioned above, and formation of V and Nb precipitates is suppressed.

Here, hot working mainly stands for hot rolling and hot forging. It is possible to perform hot rolling and further perform hot forging. Further, it goes without saying that it is possible to perform hot rolling and then cold forging as well.

Here, in a case where the hot working process right before nitrocarburizing is a hot rolling process, i.e. in a case where hot forging is not performed after hot rolling, the following conditions will be satisfied in the hot rolling process.

Rolling Heating Temperature: 950° C. to 1250° C.

In the hot rolling process, in order to prevent fine precipitates from forming on the rolled material (steel bar which becomes the blank material of the hot forged part) and causing deterioration of forgeability, carbides remaining from the time of melting are allowed to dissolve.

Here, if the rolling heating temperature is lower than 950° C., it becomes difficult for the carbides remaining from the time of melting to dissolve. On the other hand, if the rolling heating temperature exceeds 1250° C., crystal grains coarsen and forgeability tends to deteriorate more easily. Therefore, the rolling heating temperature is from 950° C. to 1250° C.

Finisher Delivery Temperature: 800° C. or Higher

In a case where the finisher delivery temperature is lower than 800° C., a ferrite phase is formed and therefore it would become disadvantageous in forming a bainite phase satisfying an area ratio of bainite phase to the whole microstructure before nitrocarburizing of more than 50%. Further, the rolling load would also increase. Therefore, the finisher delivery temperature is set to be 800° C. or higher. Further, the upper limit is preferably set be to around 1100° C.

Cooling Rate at Least in Temperature Range of 700° C. to 550° C. after Rolling: More than 0.5° C./s In order to prevent fine precipitates from forming before forging and leading to deterioration of forgeability, the cooling rate after rolling is set to be higher than 0.5° C./s, which is the critical cooling rate at which fine precipitates can be obtained, at least in the temperature range of 700° C. to 550° C., which is the temperature range where fine precipitates are formed. Further, the upper limit is preferably set be to around 200° C./s.

In a case where the hot working process right before nitrocarburizing is a hot forging process, i.e. in a case where only hot forging is performed or in a case where hot forging is performed after hot rolling, the following conditions will be satisfied in the hot forging process.

In a case where hot rolling is performed before hot forging, the above hot rolling conditions do not necessarily have to be satisfied.

Hot Forging Conditions

In hot forging, for the purpose of setting the area ratio of bainite phase to the whole microstructure to more than 50%, and preventing fine precipitates from forming from the viewpoint of cold straightening after hot forging or machinability by cutting, the heating temperature at the time of hot forging is set to 950° C. to 1250° C., the forging finishing temperature is set to 800° C. or higher, and the cooling rate after forging, at least in the temperature range of 700° C. to 550° C., is set to more than 0.5° C./s. Further, the upper limit is preferably set be to around 200° C./s.

Next, the obtained rolled material or forged material is subjected to cutting work and the like so as to have the shape of the component, and then subjected to nitrocarburizing in the following conditions.

Nitrocarburizing (Precipitation Treatment) Conditions

In order to form fine precipitates, nitrocarburizing is performed preferably at a nitrocarburizing temperature of 550° C. to 700° C. for a nitrocarburizing time of 10 minutes or more. Here, the nitrocarburizing temperature is set to a range of 550° C. to 700° C. because if the temperature is lower than 550° C., a sufficient amount of precipitates cannot be obtained, whereas if the temperature exceeds 700° C., it reaches an austenite range and makes nitrocarburizing difficult to perform. The nitrocarburizing temperature is more preferably in the range of 550° C. to 630° C.

Since N and C are immersed and diffused at the same time in nitrocarburizing, nitrocarburizing should be performed in a mixed atmosphere of nitriding gas such as $NH_3$ and $N_2$ and carburizing gas such as $CO_2$ and CO, for example in an atmosphere of $NH_3$:$N_2$:$CO_2$=50:45:5.

EXAMPLES

Examples of the present invention will be specifically described below.

In this case, 150 kg of steels having chemical compositions shown in table 1 (steel samples A to P) were prepared by steelmaking in a vacuum melting furnace, respectively, heated to 1150° C., and subjected to hot rolling at a finisher delivery temperature of 970° C., then the hot rolled bars were cooled to room temperature at a cooling rate of 0.9° C./s to obtain steel bars of 50 mmϕ. As steel sample P, a steel corresponding to JIS SCr420 was used.

For all of the steel in table 1, P and N were not positively added. Accordingly, the contents of P and N in table 1 indicate the amount mixed in as incidental impurities. Further, although Ti was positively added in steel sample N of table 1, it was not positively added in other steel samples. Accordingly, the Ti content of steel samples A, B, C, D, E, F, G, H, I, J, K, L, M, O, and P in table 1 all indicate the content mixed in as incidental impurities.

These materials were further heated to 1200° C., subjected to hot forging at a finishing temperature of 1100° C., made into steel bars of 30 mmϕ, then cooled to room temperature at a cooling rate of 0.8° C./s in the temperature range of 700° C. to 550° C. Further, for comparison, some of the materials were cooled to room temperature at a cooling rate of 0.1° C./s in the temperature range of 700° C. to 550° C.

Hot forged materials obtained in such way were evaluated on machinability by cutting, in particular drill workability by conducting drill cutting tests. Using hot forged materials cut into a thickness of 20 mm as test materials, through holes were made in 5 parts per one cross section using a straight drill of 6 mmϕ of JIS high speed tool steel SKH51 with a feed rate of 0.15 mm/rev, revolution speed of 795 rpm, and evaluation was made by the total number of holes that were made until the drill was no longer capable of cutting.

Microstructure observation and hardness measurement were conducted on the above hot forged materials.

In microstructure observation, the area ratio of each phase was obtained while identifying the phase type, by the aforementioned method.

In hardness measurement, core hardness was measured with a test load of 2.94 N (300 gf) at 5 points in accordance with JIS Z 2244 using a Vickers hardness meter, and the average value thereof was defined as hardness HV.

Then, regarding steel samples A to O, after performing the above hot forging, nitrocarburizing was further performed. On the other hand, regarding the hot forged material of steel sample P, carburizing was performed for comparison.

Nitrocarburizing was performed by heating the steel samples to a temperature range of 525° C. to 620° C. in an atmosphere of $NH_3$:$N_2$:$CO_2$=50:45:5 and holding them for 3.5 hours.

On the other hand, carburizing treatment was performed by carburizing the steel samples at 930° C. for 3 hours, holding them at 850° C. for 40 minutes, oil quenching them, and further tempering them at 170° C. for 1 hour.

Heat treated materials thus obtained were subjected to microstructure observation, hardness measurement, precipitate observation, and fatigue property evaluation.

Here, in microstructure observation, as it was before nitrocarburizing, the area ratio of each phase was obtained while identifying the phase type, by the aforementioned method.

In hardness measurement, surface hardness of the above heat treated materials was measured 0.05 mm from the surface and core hardness was measured at the center part (core part). Surface hardness measurement and core hardness measurement were both carried out with a test load of 2.94 N (300 gf) at 6 points in accordance with JIS Z 2244 using a Vickers hardness meter, and the average values thereof were each defined as surface hardness HV and core hardness HV. Further, the effective hardened case depth was defined as depth from the surface with HV400, and measurement was carried out.

Further, from the core parts of nitrocarburized material and carburized steel material, test specimens for transmission electron microscope observation were prepared by twin-jet electropolishing, and observation on precipitates was performed on the obtained test specimens using a transmission electron microscope with the acceleration voltage set to 200 kv. Further, the compositions of the observed precipitates were calculated with an energy-dispersive X-ray spectrometer (EDX).

Evaluation on fatigue properties was performed by obtaining fatigue strength using the Ono-type rotary bending fatigue test. The fatigue test was performed by collecting notched test pieces (notched R: 1.0 mm, notch diameter: 8 mm, stress concentration factor: 1.8) as test specimens from the above heat treated materials.

Table 2 shows the results of microstructure observation and hardness measurement before and after nitrocarburizing, and the results of evaluation on fatigue properties before and after nitrocarburizing. Nos. 1 to 6 are inventive examples, Nos. 7 to 16 are comparative examples, and No. 17 is a conventional example where a steel which corresponds to JIS SCr420 was subjected to carburizing treatment.

TABLE 1

| Steel | Chemical Composition (mass %) | | | | | | | | | | | | | |
|---|---|---|---|---|---|---|---|---|---|---|---|---|---|---|
| Sample | C | Si | Mn | P | S | Cr | Mo | V | Nb | Al | Sb | Ti | N | Remarks |
| A | 0.040 | 0.08 | 1.85 | 0.011 | 0.018 | 0.64 | 0.27 | 0.19 | 0.10 | 0.035 | 0.0010 | 0.001 | 0.0052 | Inventive Steel |
| B | 0.050 | 0.20 | 1.11 | 0.010 | 0.022 | 1.15 | 0.11 | 0.12 | 0.05 | 0.023 | 0.0040 | 0.003 | 0.0089 | Inventive Steel |
| C | 0.080 | 0.25 | 0.76 | 0.014 | 0.019 | 1.44 | 0.08 | 0.28 | 0.13 | 0.026 | 0.0102 | 0.002 | 0.0053 | Inventive Steel |
| D | 0.085 | 0.28 | 0.62 | 0.019 | 0.035 | 1.19 | 0.09 | 0.15 | 0.04 | 0.028 | 0.0006 | 0.002 | 0.0091 | Inventive Steel |
| E | 0.090 | 0.15 | 0.83 | 0.014 | 0.020 | 0.81 | 0.19 | 0.12 | 0.09 | 0.035 | 0.0033 | 0.001 | 0.0064 | Inventive Steel |
| F | 0.052 | 0.23 | 1.33 | 0.018 | 0.030 | 1.04 | 0.05 | 0.15 | 0.07 | 0.022 | 0.0021 | 0.004 | 0.0053 | Inventive Steel |
| G | 0.160 | 0.25 | 0.74 | 0.016 | 0.025 | 1.16 | 0.20 | 0.14 | 0.07 | 0.026 | 0.0025 | 0.003 | 0.0075 | Comparative Steel |
| H | 0.085 | 1.14 | 3.12 | 0.013 | 0.015 | 0.63 | 0.15 | 0.13 | 0.06 | 0.027 | 0.0036 | 0.002 | 0.0054 | Comparative Steel |
| I | 0.077 | 0.30 | 0.33 | 0.019 | 0.027 | 1.24 | 0.08 | 0.20 | 0.10 | 0.029 | 0.0056 | 0.003 | 0.0058 | Comparative Steel |
| J | 0.070 | 0.25 | 1.04 | 0.017 | 0.022 | 0.29 | 0.08 | 0.15 | 0.07 | 0.026 | 0.0019 | 0.002 | 0.0058 | Comparative Steel |

TABLE 1-continued

| Steel Sample | Chemical Composition (mass %) C | Si | Mn | P | S | Cr | Mo | V | Nb | Al | Sb | Ti | N | Remarks |
|---|---|---|---|---|---|---|---|---|---|---|---|---|---|---|
| K | 0.046 | 0.07 | 1.02 | 0.012 | 0.018 | 0.84 | 0.004 | 0.15 | 0.07 | 0.025 | 0.0016 | 0.001 | 0.0066 | Comparative Steel |
| L | 0.070 | 0.12 | 0.96 | 0.010 | 0.016 | 1.06 | 0.13 | 0.01 | 0.001 | 0.022 | 0.0068 | 0.002 | 0.0064 | Comparative Steel |
| M | 0.038 | 0.07 | 1.66 | 0.015 | 0.020 | 1.19 | 0.08 | 0.12 | 0.001 | 0.028 | 0.0053 | 0.001 | 0.0088 | Comparative Steel |
| N | 0.038 | 0.09 | 1.64 | 0.013 | 0.020 | 1.16 | 0.09 | 0.12 | 0.04 | 0.033 | 0.0049 | 0.030 | 0.0085 | Comparative Steel |
| O | 0.066 | 0.14 | 1.11 | 0.011 | 0.016 | 0.83 | 0.11 | 0.13 | 0.05 | 0.004 | 0.0088 | 0.002 | 0.0060 | Comparative Steel |
| P | 0.220 | 0.27 | 0.79 | 0.014 | 0.018 | 1.18 | 0.001 | 0.005 | 0.001 | 0.027 | 0.0001 | 0.004 | 0.0105 | Conventional Steel |

*The underlined values are out of the appropriate range.

TABLE 2

| No. | Steel Sample | Cooling Rate after Hot Forging (° C./s) | Steel Properties (before Nitrocarburizing) Hardness HV | Microstructure | Area Ratio of Bainite Phase (%) | Number of Drill Bored Holes (number) | Nitrocarburizing Temperature (° C.) |
|---|---|---|---|---|---|---|---|
| 1 | A | 0.8 | 241 | Mainly B | 99 | 492 | 605 |
| 2 | B | 0.8 | 245 | Mainly B | 93 | 484 | 580 |
| 3 | C | 0.8 | 267 | Mainly B | 97 | 437 | 620 |
| 4 | D | 0.8 | 269 | Mainly B | 98 | 428 | 590 |
| 5 | E | 0.8 | 267 | Mainly B | 92 | 435 | 590 |
| 6 | F | 0.8 | 240 | Mainly B | 90 | 494 | 590 |
| 7 | B | 0.1 | 230 | F + P | 0 | 522 | 590 |
| 8 | G | 0.8 | 293 | Mainly B | 97 | 197 | 590 |
| 9 | H | 0.8 | 327 | M + B | 39 | 87 | 590 |
| 10 | I | 0.8 | 291 | F + P + B | 13 | 192 | 590 |
| 11 | J | 0.8 | 285 | F + P + B | 16 | 197 | 590 |
| 12 | K | 0.8 | 214 | Mainly B | 66 | 576 | 590 |
| 13 | L | 0.8 | 252 | Mainly B | 96 | 470 | 590 |
| 14 | M | 0.8 | 241 | Mainly B | 97 | 497 | 590 |
| 15 | N | 0.8 | 240 | Mainly B | 97 | 501 | 590 |
| 16 | O | 0.8 | 249 | Mainly B | 96 | 479 | 590 |
| 17 | P | 0.8 | 248 | F + P + B | 85 | 449 | —*3 |

| No. | Steel Properties (after Nitrocarburizing) Surface Hardness HV | Effective Hardened Case Depth (mm) | Core Hardness HV | Core Microstructure | Area Ratio of Bainite Phase (%) | Fatigue Strength (MPa) | Remarks |
|---|---|---|---|---|---|---|---|
| 1 | 788 | 0.15 | 296 | Mainly B | 99 | 515 | Inventive Example |
| 2 | 795 | 0.17 | 276 | Mainly B | 93 | 475 | Inventive Example |
| 3 | 806 | 0.19 | 326 | Mainly B | 97 | 575 | Inventive Example |
| 4 | 796 | 0.17 | 299 | Mainly B | 98 | 526 | Inventive Example |
| 5 | 784 | 0.15 | 295 | Mainly B | 92 | 508 | Inventive Example |
| 6 | 791 | 0.16 | 279 | Mainly B | 90 | 476 | Inventive Example |
| 7 | 788 | 0.15 | 227 | F + P | 0 | 348 | Comparative Example |
| 8 | 800 | 0.18 | 323 | Mainly B | 97 | 569 | Comparative Example |
| 9 | 786 | 0.15 | 353 | M + B | 39 | 640 | Comparative Example |
| 10 | 802 | 0.18 | 301 | F + P + B | 13 | 530 | Comparative Example |
| 11 | 837 | 0.17 | 296 | F + P + B | 16 | 515 | Comparative Example |
| 12 | 787 | 0.18 | 231 | Mainly B | 66 | 374 | Comparative Example |
| 13 | 795 | 0.16 | 249 | Mainly B | 96 | 415 | Comparative Example |
| 14 | 789 | 0.17 | 251 | Mainly B | 97 | 418 | Comparative Example |
| 15 | 787 | 0.17 | 250 | Mainly B | 97 | 416 | Comparative Example |
| 16 | 724 | 0.12 | 278 | Mainly B | 96 | 395 | Comparative Example |
| 17 | 730 | 1.05 | 360 | Quenched M + B | 50 | 470 | Conventional Example |

*1 The underlined values are out of the appropriate range.
*2 The alphabets regarding microstructure each represent the following phases. F: Ferrite, P: Pearlite, B: Bainite, M: Martensite
*3Carburizing treatment was performed.

As it is clear from table 2, inventive example Nos. 1 to 6 all show better fatigue strength compared to conventional example No. 17 which was subjected to carburizing treatment. The drill workability before nitrocarburizing of inventive example Nos. 1 to 6 is a level equivalent to or higher than conventional example No. 17.

Further, as a result of observation of precipitates using a transmission electron microscope and investigation on precipitate composition using an energy-dispersive X-ray spectrometer (EDX), it was confirmed that, as for example Nos. 1 to 6 of the material subjected to nitrocarburizing, 500 or more fine precipitates with a diameter of less than 10 nm including V, Nb were dispersedly precipitated per 1 $\mu m^2$ in the bainite phase. From these results, it is considered that the material subjected to nitrocarburizing according to the present invention showed high fatigue strength due to precipitation strengthening caused by the above fine precipitates.

On the other hand, the chemical compositions or the obtained steel microstructures of comparative example Nos. 7 to 16 were out of the scope of the present invention, which means that they were inferior in fatigue strength or drill workability.

Regarding example No. 7, since the cooling rate after hot forging was slow, an appropriate amount of bainite phase was not obtained, and the formation amount of fine precipitates obtained by nitrocarburizing was small. Therefore, precipitation strengthening was insufficient and the fatigue strength was lower compared to the inventive examples.

Regarding example No. 8, since the C content exceeded the appropriate range, the hardness of the hot forged material before nitrocarburizing increased and drill workability decreased.

Regarding example No. 9, since the Si content and Mn content exceeded the appropriate range, hardness of the hot forged material before nitrocarburizing increased and drill workability decreased to approximately ⅕ of that of conventional example No. 17.

Regarding example No. 10, since the Mn content was below the appropriate range, the steel microstructure of the hot forged material before nitrocarburizing was mainly composed of ferrite phase—pearlite phase. Therefore, V and Nb precipitates were formed in the microstructure, and hardness before nitrocarburizing increased and drill workability decreased.

Regarding example No. 11, since the Cr content was below the appropriate range, the steel microstructure of the hot forged material before nitrocarburizing was mainly composed of ferrite phase—pearlite phase. Therefore, V and Nb precipitates were formed in the microstructure, and hardness before nitrocarburizing increased and drill workability decreased.

Regarding example No. 12, since the Mo content was below the appropriate range, the formation amount of fine precipitates after nitrocarburizing was small and sufficient core hardness was not obtained. Therefore, the fatigue strength of example No. 12 was lower than that of conventional example No. 17.

Regarding example No. 13, since the V content and the Nb content were below the appropriate range, the formation amount of fine precipitates after nitrocarburizing was small and sufficient core hardness was not obtained. Therefore, the fatigue strength of example No. 13 was lower than that of conventional example No. 17.

Regarding example No. 14, since the Nb content was below the appropriate range, the formation amount of fine precipitates after nitrocarburizing was small and sufficient core hardness was not obtained. Therefore, the fatigue strength of example No. 14 was lower than that of conventional example No. 17.

Regarding example No. 15, since the content of Ti which is an impurity component in the present invention was high, the formation amount of fine precipitates after nitrocarburizing was small and sufficient core hardness was not obtained. Therefore, the fatigue strength of example No. 15 was lower than that of conventional example No. 17.

Regarding example No. 16, since the Al content was below the appropriate range, sufficient surface strength after nitrocarburizing and effective hardened case depth were not obtained and therefore the fatigue strength was lower than that of conventional example No. 17.

The invention claimed is:

1. A steel for nitrocarburizing, the steel consisting of, by mass %:

C: 0.01% or more and less than 0.10%;
Si: 1.0% or less;
Mn: 0.5% to 3.0%;
P: 0.02% or less;
S: 0.06% or less;
Cr: 0.3% to 3.0%;
Mo: 0.005% to 0.4%;
V: 0.02% to 0.5%;
Nb: 0.003% to 0.15%;
Al: 0.005% to 0.2%;
Sb: 0.0005% to 0.02%;
Ti: less than 0.010%; and
the balance being Fe and incidental impurities,
wherein an area ratio of bainite phase to a whole microstructure is more than 50%.

2. The steel for nitrocarburizing according to claim 1, wherein a content of Ti is less than 0.005 mass %.

3. The steel for nitrocarburizing according to claim 1, wherein a content of Sb is 0.0005 to 0.01 mass %.

4. A nitrocarburized component obtained by forming the steel for nitrocarburizing according to claim 1 into a desired shape, and then subjecting it to nitrocarburizing.

5. The nitrocarburized component according to claim 4, wherein after the nitrocarburizing, precipitates including V and Nb are dispersed in a bainite phase.

6. A method for manufacturing a steel for nitrocarburizing, the method comprising:

hot working a steel at a heating temperature in a range of 950° C. to 1250° C. and finishing temperature of 800° C. or higher, the steel having a chemical composition consisting of, by mass %:
C: 0.01% or more and less than 0.10%;
Si: 1.0% or less;
Mn: 0.5% to 3.0%;
P: 0.02% or less;
S: 0.06% or less;
Cr: 0.3% to 3.0%;
Mo: 0.005% to 0.4%;
V: 0.02% to 0.5%;
Nb: 0.003% to 0.15%;
Al: 0.005% to 0.2%;
Sb: 0.0005% to 0.02%;
Ti: less than 0.010%; and
the balance being Fe and incidental impurities; and then cooling the worked steel at a cooling rate of more than 0.5° C./s at least at a temperature in a range of 700° C. to 550° C.

7. A method for manufacturing a nitrocarburized component, wherein the steel for nitrocarburizing obtained by the manufacturing method according to claim 6 is formed into a desired shape and then subjected to nitrocarburizing at a nitrocarburizing temperature in a range of 550° C. to 700° C. for a nitrocarburizing time of 10 minutes or longer.

* * * * *